US008007380B2

(12) United States Patent
Rosenkranz et al.

(10) Patent No.: US 8,007,380 B2
(45) Date of Patent: Aug. 30, 2011

(54) RACKET WITH MOVEABLY MOUNTED BRIDGE

(75) Inventors: Harald Rosenkranz, Lauterach (AT); Johan Kotze, Wolfurt (AT); Stefan Mohr, Wolfurt (AT); Ralf Schwenger, Weiler im Allgäu (DE)

(73) Assignee: Head Technology GmbH, Kennelbach (AT)

( * ) Notice: Subject to any disclaimer, the term of this patent is extended or adjusted under 35 U.S.C. 154(b) by 93 days.

(21) Appl. No.: 12/292,751

(22) Filed: Nov. 25, 2008

(65) Prior Publication Data

US 2009/0163306 A1 Jun. 25, 2009

(30) Foreign Application Priority Data

Nov. 26, 2007 (EP) ..... 07022859

(51) Int. Cl.
*A63B 49/02* (2006.01)

(52) U.S. Cl. ..... 473/546; 473/521

(58) Field of Classification Search ..... 473/520, 473/521, 524, 546
See application file for complete search history.

(56) References Cited

U.S. PATENT DOCUMENTS

| | | | | |
|---|---|---|---|---|
| 1,937,787 | A | 12/1933 | Robinson | |
| 4,209,170 | A | 6/1980 | Garver | |
| 4,247,103 | A | 1/1981 | Garver | |
| 4,311,308 | A | 1/1982 | Völkl et al. | |
| 4,550,909 | A * | 11/1985 | Sommer | 473/546 |
| 4,828,260 | A * | 5/1989 | Todd | 473/521 |
| 4,889,338 | A * | 12/1989 | Keijiro | 473/546 |
| 5,076,583 | A * | 12/1991 | Hsu | 473/537 |
| 5,133,552 | A | 7/1992 | Feeney et al. | |
| 5,172,911 | A * | 12/1992 | Chang | 473/521 |
| 5,282,617 | A | 2/1994 | Hong | |
| 5,324,030 | A * | 6/1994 | Tsou | 473/521 |
| 5,350,173 | A * | 9/1994 | DiCerbo | 473/521 |
| 5,599,018 | A * | 2/1997 | Radel | 473/521 |
| 5,779,572 | A | 7/1998 | Dicerbo | |
| 7,229,369 | B2 * | 6/2007 | Schwenger | 473/546 |
| 2005/0277496 | A1 * | 12/2005 | Schwenger | 473/546 |
| 2009/0163306 | A1 * | 6/2009 | Rosenkranz et al. | 473/546 |

FOREIGN PATENT DOCUMENTS

| | | | |
|---|---|---|---|
| DE | 36 09 453 | A1 | 10/1987 |
| FR | 2 845 610 | | 4/2004 |
| JP | 53063138 | A * | 6/1978 |

* cited by examiner

*Primary Examiner* — Raleigh W. Chiu
(74) *Attorney, Agent, or Firm* — Finnegan, Henderson, Farabow, Garrett & Dunner, LLP

(57) ABSTRACT

The disclosure relates to a racket for ball games, and in particular, a tennis or squash racket, with a head region for receiving a stringing defining a stringing plane, a grip portion for holding the racket, and a heart region wherein the heart region has two arms and a bridge. The bridge may be pivot-mounted on both arms relative to an axis substantially perpendicular to the stringing plane. The present disclosure further relates to a method for manufacturing a racket including the step of manufacturing a racket frame with a head region, two arms, and a grip portion in a blow molding process. The method may also include manufacturing a bridge for a racket frame in the blow molding process. The method may further include connecting the bridge with the remaining racket frame.

13 Claims, 16 Drawing Sheets

RACKET WITH MOVEABLY MOUNTED BRIDGE

BACKGROUND

1. Technical Field

The present disclosure relates to a racket for ball games, in particular a tennis, badminton, racquetball, or squash racket.

2. Description of the Related Art

Ball game rackets typically have a frame forming a racket head or a head region as well as a grip or handle portion. Furthermore, rackets can have a throat or heart portion or a fork being arranged between the head region and the grip portion, wherein the racket head defines a stringing plane in which the stringing of the racket is arranged. For retaining the individual strings of the stringing, through holes through which the individual strings can be passed are provided at the frame in the stringing plane.

Moreover it is known that it can be advantageous to form the bridge with a mechanical break or slit and to optionally additionally insert a dampening material into the bridge.

U.S. Pat. No. 5,282,617 for example discloses a ball game racket with a head portion, a handle portion and two arm portions being arranged in a V-shaped manner and whose ends pass into the handle portion and then merge. The racket further comprises a spring-mounted arm which extends from the transition area of both arm portions towards the head portion. This spring-mounted arm forms a yoke or bridge at its end which retains part of the strings. An elongated dwell time of the ball in the string bed is allegedly achieved due to the springing.

Moreover, U.S. Pat. No. 5,779,572 describes a sport racket with a split bridge that comprises a break in which an insert part is arranged in order to reduce player arm stress in use.

U.S. Pat. No. 4,311,308 describes a tennis racket with an insert part in the heart region to which at least a few strings can be secured. This insert part can be developed in the shape of a hinge with a hinge axis in the stringing plane and basically parallel to the longitudinal axis of the racket. The insert part should be able to be elastically deformable due to the impulse of an incoming ball, namely in a direction perpendicular to the stringing plane.

U.S. Pat. No. 5,133,552 discloses a tennis racket whose frame shows curved recesses in the heart region. A yoke piece (or a bridge) has curved ends which are basically adapted to the curving of these recesses. Between the yoke ends and the recesses of the frame a dampening disc made of elastomeric material is provided. This dampening disc should help to diminish shocks and vibrations in the racket.

FR 2 845 610 describes a tennis racket whose frame comprises a fork with two arms. A bar completes the frame between both arms wherein the connection between the bar and the arms comprises at least one mechanical break. Optionally, elastic connection pieces are provided between each of the arms and the bar.

Usually, the frame of such a racket is formed by a frame profile which is often produced of a carbon fiber reinforced plastics material in a molding press by blow molding. Generally, the bridge is pressed together and thus connected with the remaining frame. One alternative is the subsequent bolting of a bridge portion produced in a different way.

Thus, for example U.S. Pat. No. 4,209,170 describes a tennis racket with a bridge insert made of an elastomeric material which is affixed to the frame of the racket by means of fixing elements.

With the rackets known from the prior art, an optimal ball control, an optimal stiffness and optimal damping behavior of a racket is, however, not given so that accuracy, impulse absorption and handling or playability behavior of these known rackets have further room for improvement. Furthermore, with the rackets known from the prior art, no optimal acceleration that is transferable from the racket to the ball can be achieved. In particular, with the rackets already known it is not yet possible to selectively control the deformation of the racket frame caused by the impact of the ball onto the racket and the respective impulse absorption or to effectively transform the impulse into striking power.

Furthermore, the known method for manufacturing a racket, namely producing the whole frame in one step by blow molding, is disadvantageous as the connection of the bridge portion to the remaining frame is labor-intensive and can often cause flawed seams or breaks at the transition.

SUMMARY OF THE DISCLOSURE

According to one aspect of the present disclosure, an improved ball racket, in particular an improved tennis, badminton, racquetball, and/or squash racket, is provided. Further or additional aspects of the disclosure are to provide a racket that overcomes the disadvantages of the prior art, that provides improved handling or optimized playability characteristics and that allows an excellent ball control and ball acceleration. Furthermore, it is an aspect of the present disclosure to provide an improved method for manufacturing ball rackets, which abolishes or at least minimizes the disadvantages of the conventional process mentioned above and which is easy and cost-effective to realize.

According to one aspect of the disclosure, a racket for ball games is provided with a head region for retaining a stringing defining a stringing plane, a grip or handle portion for holding the racket, and a heart portion, wherein the heart portion comprises two arms and one bridge and the bridge is pivot-mounted to both arms relative to an axis basically perpendicular to the stringing plane.

In a preferred embodiment the bridge comprises two legs which are moveably mounted to the arms and are connected, preferably in the middle, via a hinge. The bridge, however, can also be mounted to the arms in a different way that allows a corresponding pivot-mounting, wherein, however, the bridge is to be held by the frame alone. This means that the bridge should not be pressed to the frame by the strings and loosen from the frame when the frame is not stringed.

According to a further aspect of the present disclosure, a racket for ball games, in particular a tennis or squash racket, is provided with a head region for retaining a stringing defining a stringing plane, a grip or handle portion for holding the racket, and a heart region with two arms and one bridge, wherein each arm has an opening in which end portions of the bridge are inserted.

In the embodiments described above, it is preferred that the bridge and both arms are connected to each other via a dampening piece or fitting piece. The dampening piece can be arranged between the bridge and mounting position or be directly integrated into the mounting.

In a preferred embodiment, the openings have head side and handle side margins and the end portions of the bridge form a form closure together with the head side margins. Thereby, free space can remain between the end portions of the bridge and the handle side margins of the openings. In this free space a dampening piece or fitting piece can be inserted. Thereby, movement of the bridge towards the handle can be prevented or dampened.

The bridge can be produced for example of carbon fiber reinforced or glass fiber reinforced plastics material or another appropriate, preferably elastic material. For example fiber reinforced plastics materials, thermoplastic injection-molded materials like polyamide with up to 50% enhancement by short carbon fibers, shape memory alloys and the like can be used here. The dampening piece preferably consists of an elastomeric material, for example of acrylonitrile-butadiene-rubber (NBR) or ethylene-propylene-diene-rubber (EPDM). Thermoplastic elastomeric materials (TPE) like for example thermoplastic polyurethanes (TPU) are advantageous as well.

According to a first alternative, the bridge can be shaped convexly, in particular basically V- or U-shaped relative to the grip portion, wherein the opening of the V or U points towards the head region. In a second alternative, the bridge can be shaped concavely, in particular basically V- or U-shaped relative to the grip portion, wherein the opening of the V or U points towards the grip portion.

The bridge can also have different shapes advantageous to the flexural behaviour, for example a double S-shape or generally a shape in which the bridge has at least two turning points along its length.

It is desired that the pivot-mounting of the bridge forms axes of rotation at both arms which have a distance of at least 8 cm, preferably at least 10 cm and particularly preferably more than 12 cm. When dimensioning the bridge it is further advantageous when the bridge is built to carry at least 10, preferably 12 strings of the stringing.

As already mentioned, different affixing or mounting possibilities of the bridge to the arms are provided. However, it is particularly desired that pivoted motions or deformations in general are allowed in the racket or stringing plane, whereas pivoted motions emerging from this plane should basically be avoided. Thus, for example the bridge can have a fork at each of its ends which is able to mount the bridge on both arms. Alternatively, the arms can each have a nose or bulge which is suitable to mount the bridge on both arms using appropriately shaped end portions. For this purpose, the ends of the bridge advantageously have correspondingly shaped notches or retaining portions which cooperate with the bulges of the arms preferably in a form-closed way.

The option according to which the arms each have an opening, in which the end portions of the bridge are inserted was already mentioned. In this case it is also possible that the bridge is hollow and open on both ends so that a complete channel through both arms and the bridge is provided. Depending on the curving of the bridge it can then also be possible that one can look through the bridge from the side of the racket. Furthermore, due to its shape and/or via a means additionally arranged therein, the cavity of the bridge can be suitable to produce a sound when the air streams past the ends of the bridge, for example by exciting a vibration in the cavity.

According to yet another aspect of the present disclosure, a method for manufacturing a racket is provided with the following steps: manufacturing a racket frame with a head region, two arms, and a grip or handle portion by blow molding; manufacturing a bridge for a racket frame by blow molding; and connecting the bridge with the remaining racket frame.

In a preferred embodiment of the method the connection of the bridge with the remaining racket frame is effected without connection straps.

The manufacturing of the frame is made by blow molding in the usual manner with the usual parameters. One aspect of the disclosure is based on the idea of manufacturing bridge and remaining frame separately by blow molding and subsequently connecting both parts resulting therefrom. This step can be carried out in different ways. For example adhering or screwing together the individual parts or pressing the bridge into a correspondingly fitting retaining area in the frame would be conceivable. Alternatively, it is conceived to insert the bridge into bores or breaks of the arms of the racket. Spaces could then be filled with an elastomeric material for example by injection molding.

An advantage of the method according to the present disclosure is that the step of usual blow-molding that is most prone to errors, namely connecting the bridge with the remaining frame during blow molding is not needed. Since this connection often leads to cracks or breaks, a lot of wasted products are produced. In the process according to the present disclosure, this is avoided as the subsequent connection of the individual parts can be effected easily and flawlessly. Thereby the process gets inter alia cost-savings.

BRIEF DESCRIPTION OF THE DRAWINGS

Hereafter a racket according to the present disclosure is described by means of several preferred embodiments with reference to the Figures in which.

DETAILED DESCRIPTION

Figure 1:
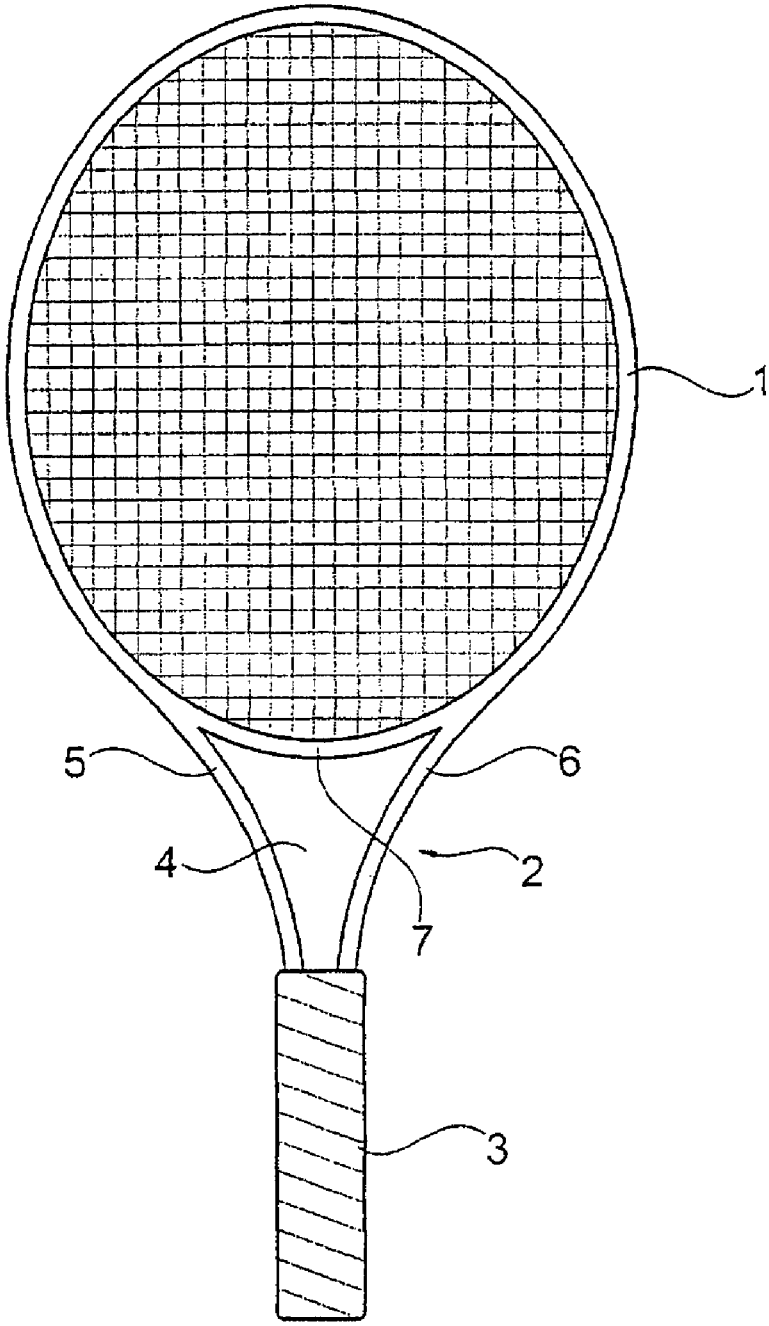
Fig. 1 Prior Art
FIG. 1 is a top view of a usual ball game racket.

FIG. 1 shows a usual ball game racket, in particular a tennis racket in top view. The ball game racket has a frame which forms a basically oval racket head or head region 1, a heart region 2 and a grip or handle portion 3. The frame is preferably made of a frame profile or hollow profile. The racket head defines a stringing plane of the racket. For retaining the stringing, the frame has a plurality of through holes (not shown) in the head region 1 lying essentially in the stringing plane and serving for passing strings there through. The heart region 2 of the racket is basically arranged between head region 1 and grip portion 3 and forms the connection region between them. The heart region 2 has an opening 4 as shown in FIG. 1. The opening is usually formed by two side portions or arms 5 and 6 as well as a connection portion or a bridge 7 arranged in the head portion 1 of the racket.

Figure 2:
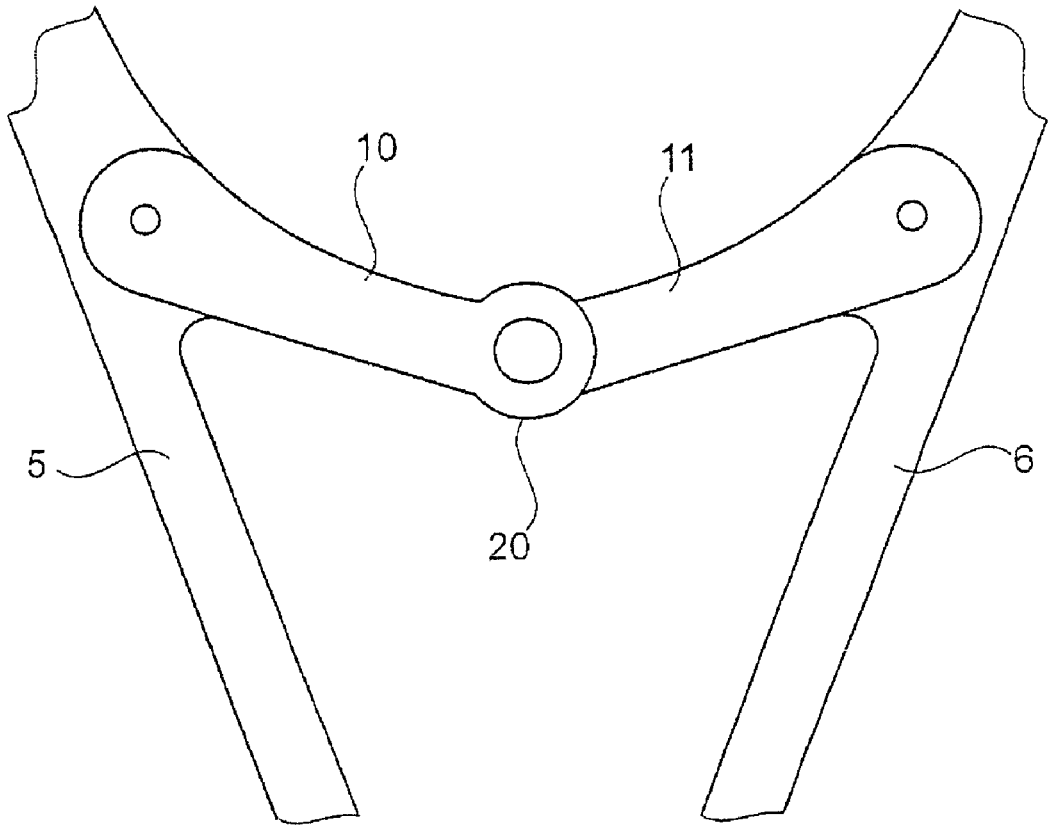
FIG. 2 is a top view of the heart region of a ball game racket according to a preferred embodiment of the present disclosure.

FIG. 2 shows the heart region of a preferred embodiment of a ball racket according to the present disclosure. In this embodiment, the bridge has two legs 10 and, 11, which are moveably mounted to the arms 5 and 6 and are connected via a hinge 20. The hinge shown in FIG. 2 is only an example and can also be technically realized in a different way. In the alternative of the embodiment shown, the bridge is formed convexly relative to the grip portion, namely U-shaped, wherein the opening of the U points towards the head portion.

Figure 3:
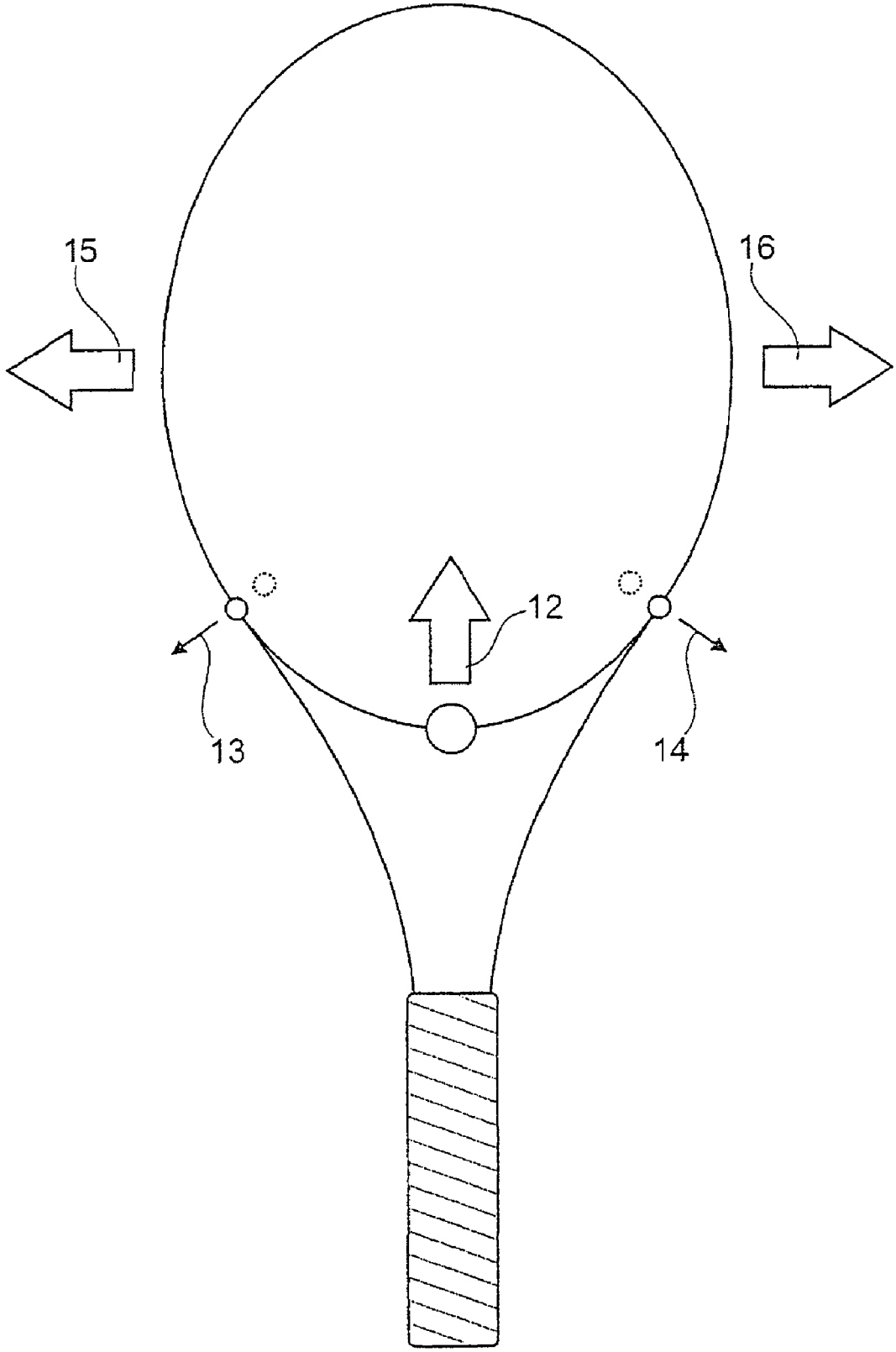
FIG. 3 is a schematic diagram of the mechanism of the hinge according to FIG. 2.

FIG. 3 shows a schematic diagram in order to illustrate the mechanism of the hinge according to FIG. 2. If a ball hits the stringing (not shown), the stringing is deflected due to the impulse transfer, which results in a force being applied onto the bridge 7 in direction of the arrow 12. A usual racket having a basically stiff bridge would react by deforming the bridge a little. Since the bridge 7 according to the present disclosure has said hinge 20, the bridge 7 will give in to the force 12 and the hinge axis will move along the arrow 12. However, as a result thereof and due to the convex form of the bridge, both mounting portions of the arms 5 and 6 inevitably slide outwardly, namely in the directions of the arrows 13 and 14. Thereby, the whole head region 1 of the racket is spread, the frame pieces at about 3 and 9 o'clock are pressed in opposite directions in accordance with the arrows 15 and 16, i.e. outwardly, whereby the transverse strings lying in between are stretched additionally.

As a result thereof, a racket according to the embodiment shown in FIGS. 2 and 3 causes a cushioning of the ball impulse on the longitudinal strings with simultaneous enhancement of the impulse on the transverse strings.

Figure 4:
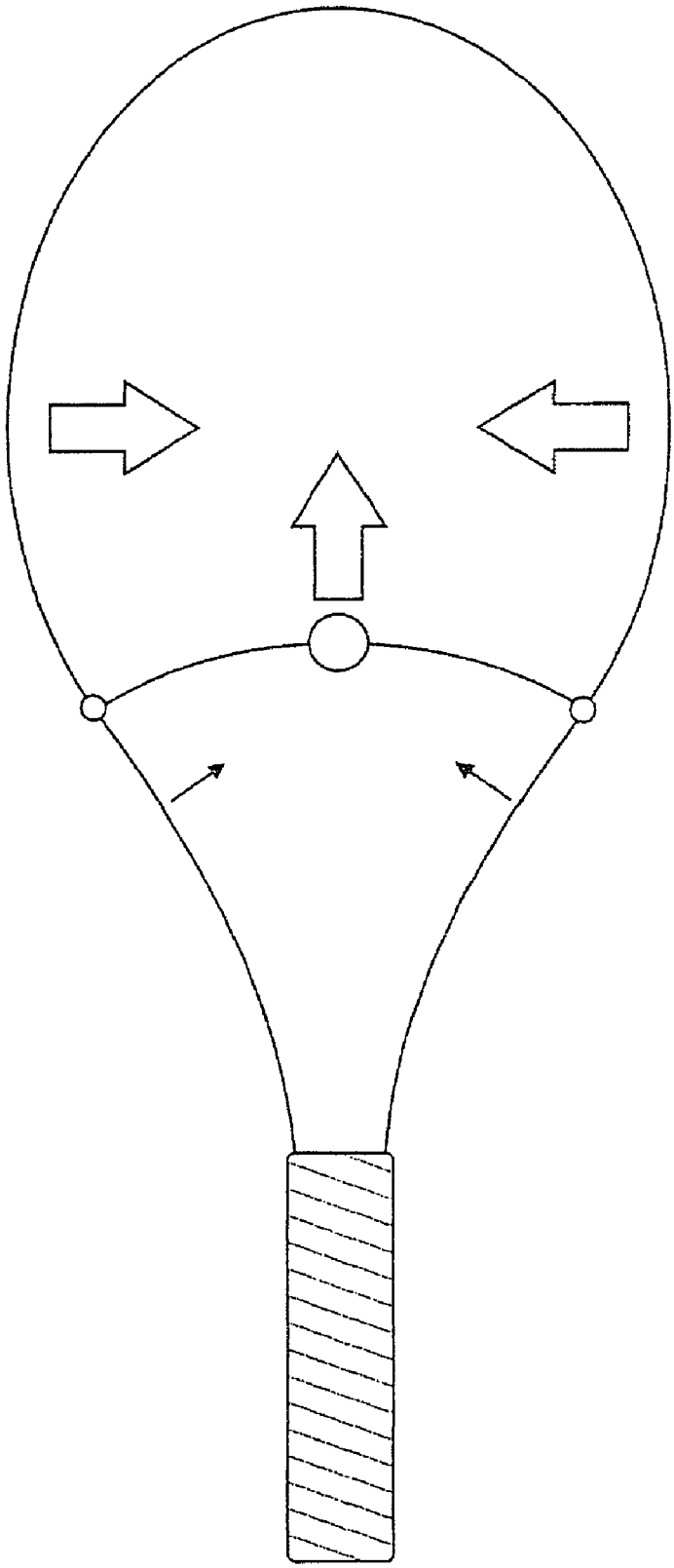
FIG. 4 is a schematic diagram of the mechanism of the hinge according to one alternative of the embodiment in FIG. 2.

According to a further alternative of this embodiment, as shown in FIG. 4, the bridge is formed concavely relative to the grip portion, namely U-shaped, wherein the opening of the U points towards the grip portion. Analogous to the explanations above it is clear that in this alternative the ball's impact on the strings has an essentially contrary effect. The deformation of the bridge 7 causes the head region 1 to tighten and thus the transverse strings to loosen, as shown with the respective arrows.

It can be advantageous that the hinge 20 has at least one end stop to limit and/or slow down the deflection of the hinge in order to be able to systematically control the deformation of the bridge. Thus, it is desired that the hinge allows deflections vis-à-vis the neutral position in the range of −15 to 15 degrees, preferably from −10 to 10 degrees, particularly preferably from −5 to 5 degrees. Moreover, for this purpose the hinge 20 can alternatively or additionally have a spring means that counteracts to the deflection of the hinge. The spring constant of this spring means ranges between 5 and 100 N/cm, preferably between 30 and 70 N/cm. In particular, also non-linear springs or spring means can advantageously be applied in this context. Furthermore, it is possible that the spring means comprises two different working ranges so that for example inward deflections of the hinge 20, i.e. towards the stringing, are exposed to a stronger spring force than outward deflections. The stops to limit the deflection can as well allow different deflection angles inwardly and outwardly.

Figure 5:
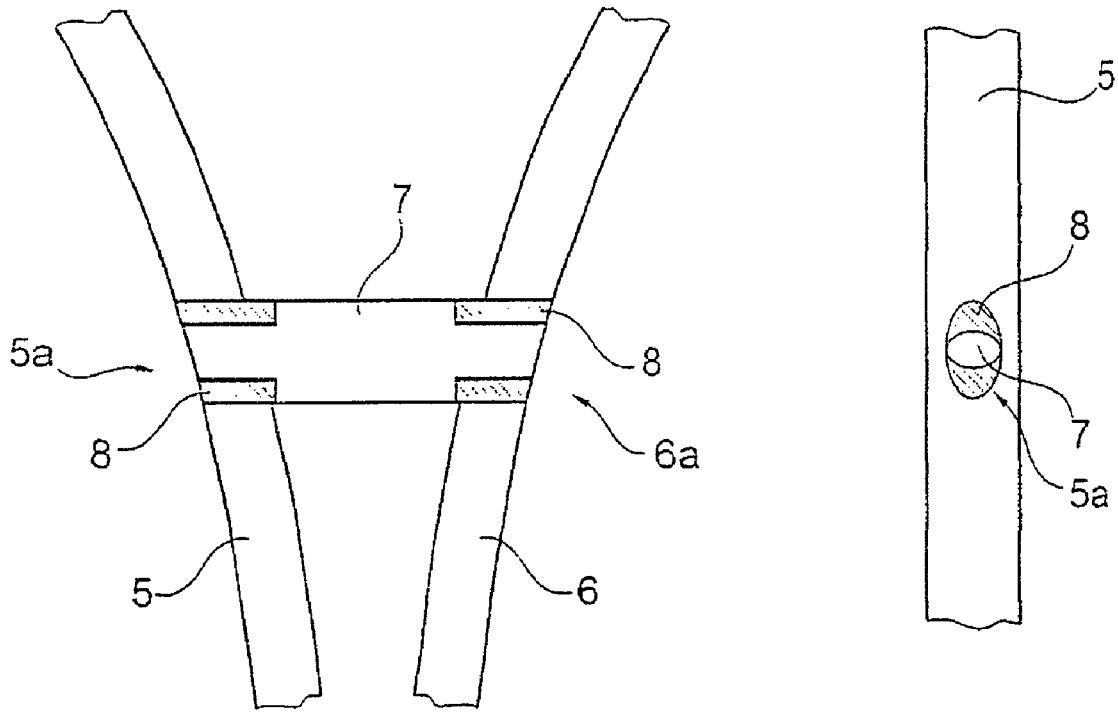
FIG. 5 is a section through and a side view of the heart region of a ball game racket according to a further preferred embodiment of the disclosure.

FIG. 5 shows a further preferred embodiment of the disclosure in the longitudinal section. Thus, the arms 5 and 6 have openings or breakthroughs 5*a* and 6*a*, respectively, in which the ends of the bridge 7 can be inserted. Optionally, there is a dampening material 8 between the ends of the bridge 7 and the arms 5 and 6. This can be for example an elastomeric material that dampens parts of the impulse received by the strings and afterwards transferred to the bridge. Advantageously, the maximum diameter of the bridge 7 and/or its shape is configured such that the bridge can be inserted into the finalized frame via one of the openings 5*a* or 6*a*. Subsequently, the bridge 7 can be affixed to the frame by inserting the dampening material 8.

Figure 6:
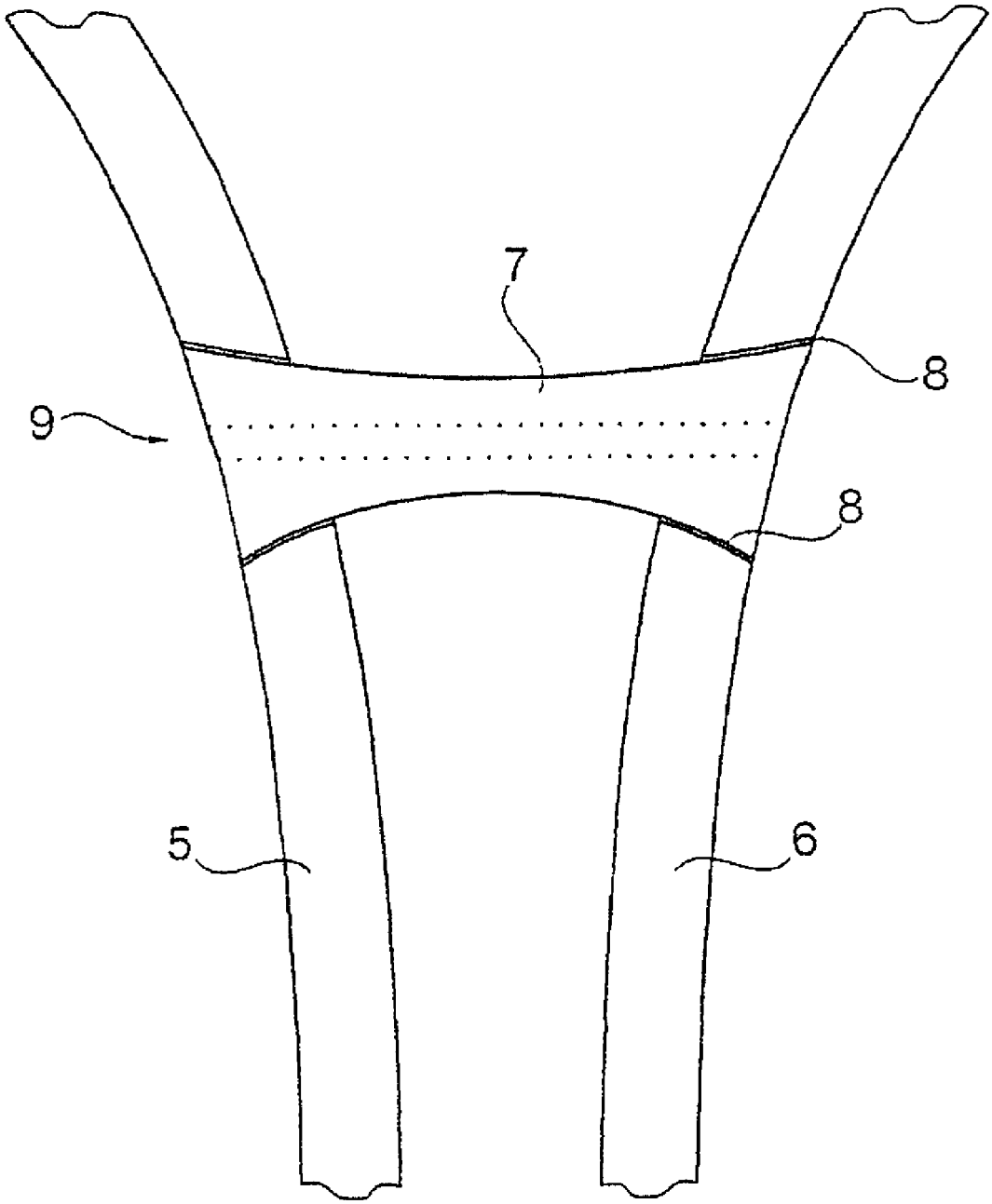
FIG. 6 is a section through the heart region of a ball game racket according to a further preferred embodiment of the present disclosure.

Obviously, the bridge 7 can also have another shape, for example the convex or concave shape described with regard to FIGS. 2 and 3. A concave/concave embodiment as shown in FIG. 6 is also possible. This alternative makes it for example possible that the bridge 7 is hollow and open on both ends so that a complete channel 9 through both arms and the bridge is provided. This can be desired for aesthetic reasons. In particular, thus a sound can be produced when air streams past the ends of the bridge, for example by exciting a vibration in the cavity.

Figure 7:
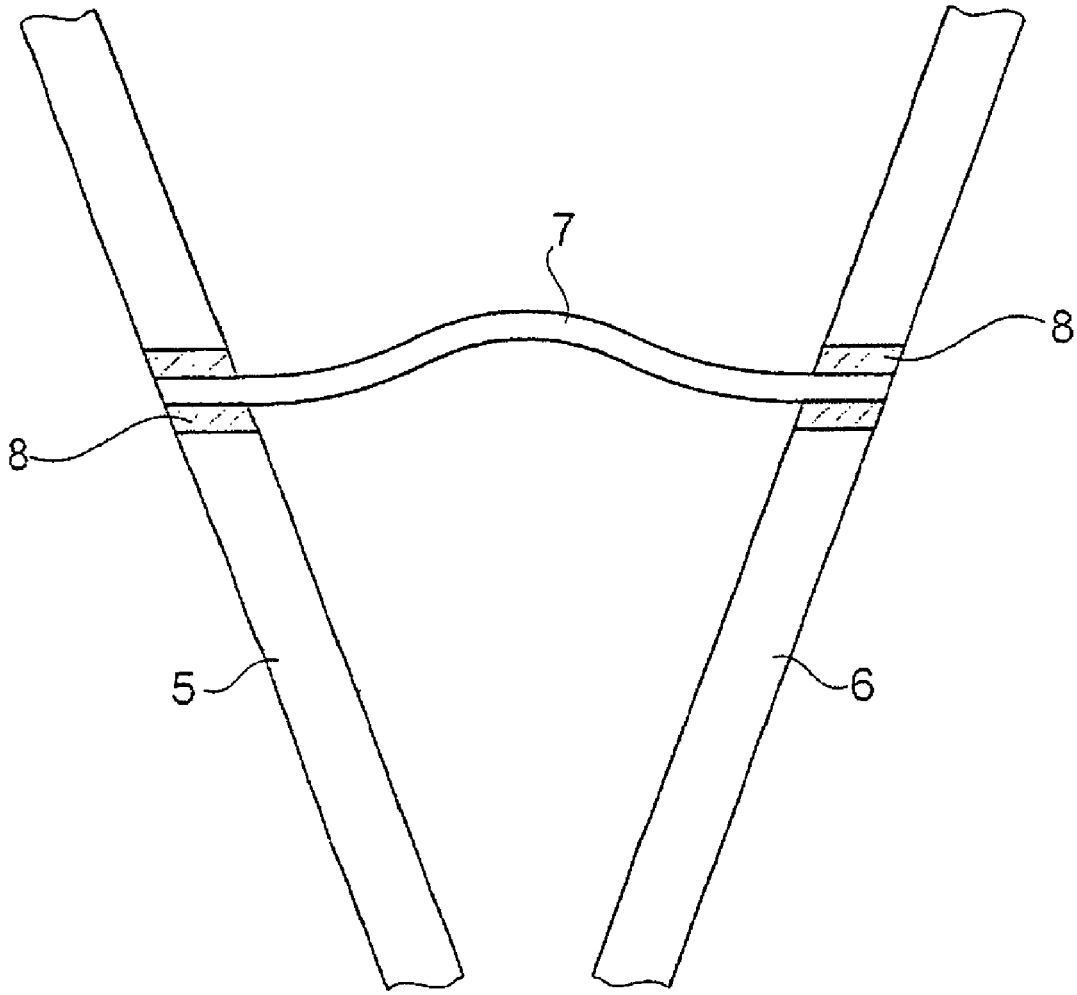
FIG. 7 is a section through the heart region of a ball game racket according to a further preferred embodiment of the present disclosure.

The embodiments shown in FIGS. 5 and 6 also cause a pivot-mounting of the bridge, in particular when the additional dampening material is provided. Since the bridge 7 is not affixed stiffly to the arms 5 and 6, it can move relative to these for example by deforming the dampening material. With a corresponding design of the region in which the dampening material is inserted, the type of movement can be influenced. If for example the ends of the bridge 7 are not completely wrapped with dampening material 8 but, as in the side view shown in FIG. 5, only the longitudinal edges, in particular pivoted movements with an axis perpendicular to the stringing plane are allowed. Further degrees of freedom are, however, largely suppressed. A further possibility to influence the degrees of freedom of the bridge's deformation is to produce the bridge suitably elastically. This can be effected by choosing appropriate materials or for example regarding a blow-molded bridge by corresponding arrangement of the carbon fibres. Further, it is also imaginable to combine the bridge moveably mounted via dampening elements with the hinge shown in FIGS. 2 to 4. In order to provide better bending or vibration characteristics, the bridge can also have a double S-shape, as indicated in FIG. 7.

Generally it is desired that the pivoted mounting of the bridge forms two pivoting axes on both arms which have a distance of at least 8 cm, preferably at least 10 cm. It is further advantageous that the bridge is dimensioned so as to receive at least 10, preferably 12 strings of the stringing.

Figure 8:
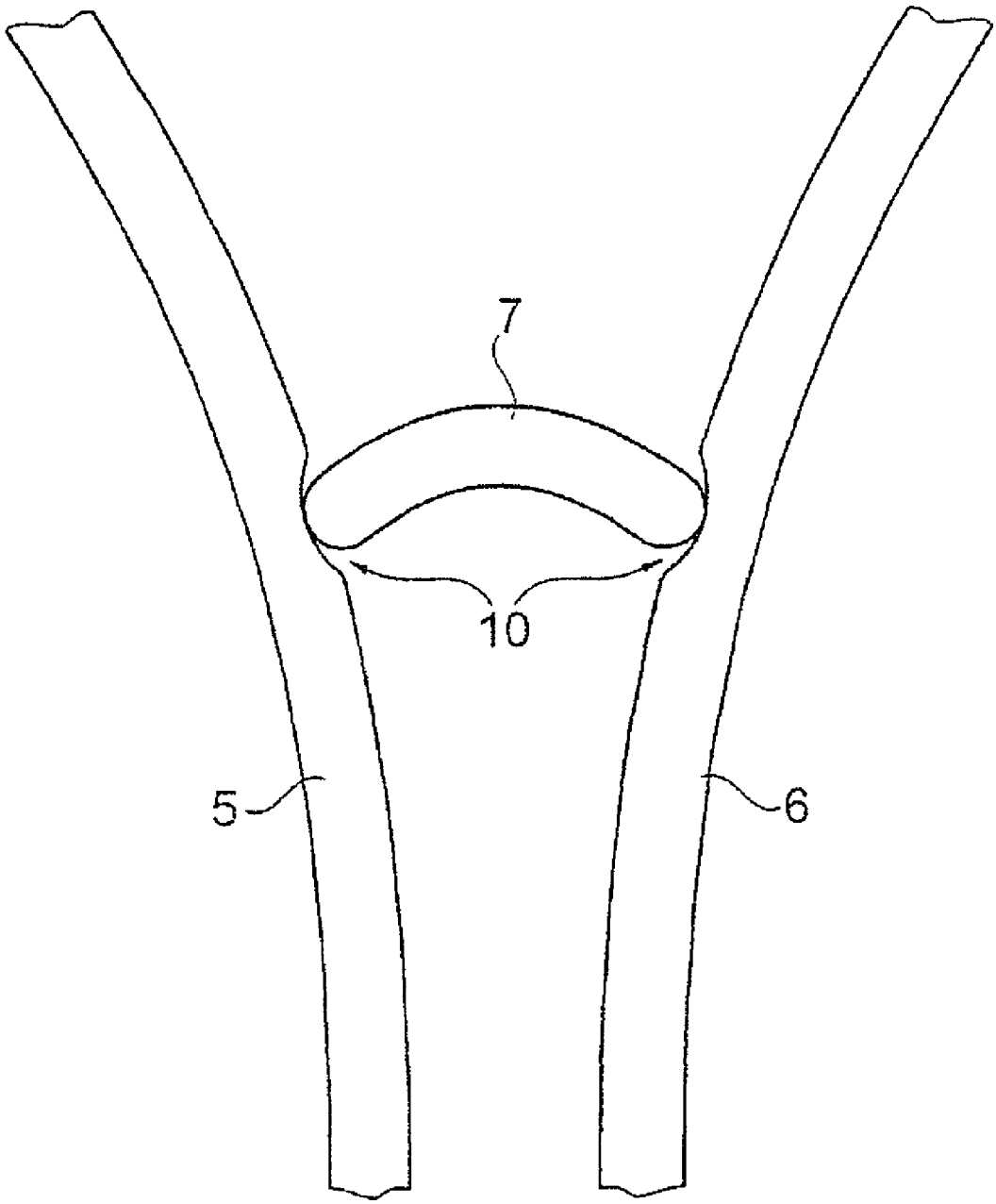
FIG. 8 is a section through the heart region of a ball game racket according to a further preferred embodiment of the present disclosure.

A further preferred embodiment of the disclosure is shown in FIG. 8. According to this embodiment, the bridge 7 is moveably mounted to both arms 5 and 6 by fitting them into recesses 10 in the arms 5 and 6. Even if here no dampening material is shown, it can be provided to make a corresponding pivoting movement of the bridge 7 around the mounting regions possible or to control a corresponding movement of the bridge 7 via specific material properties of the dampening material.

Figure 9:
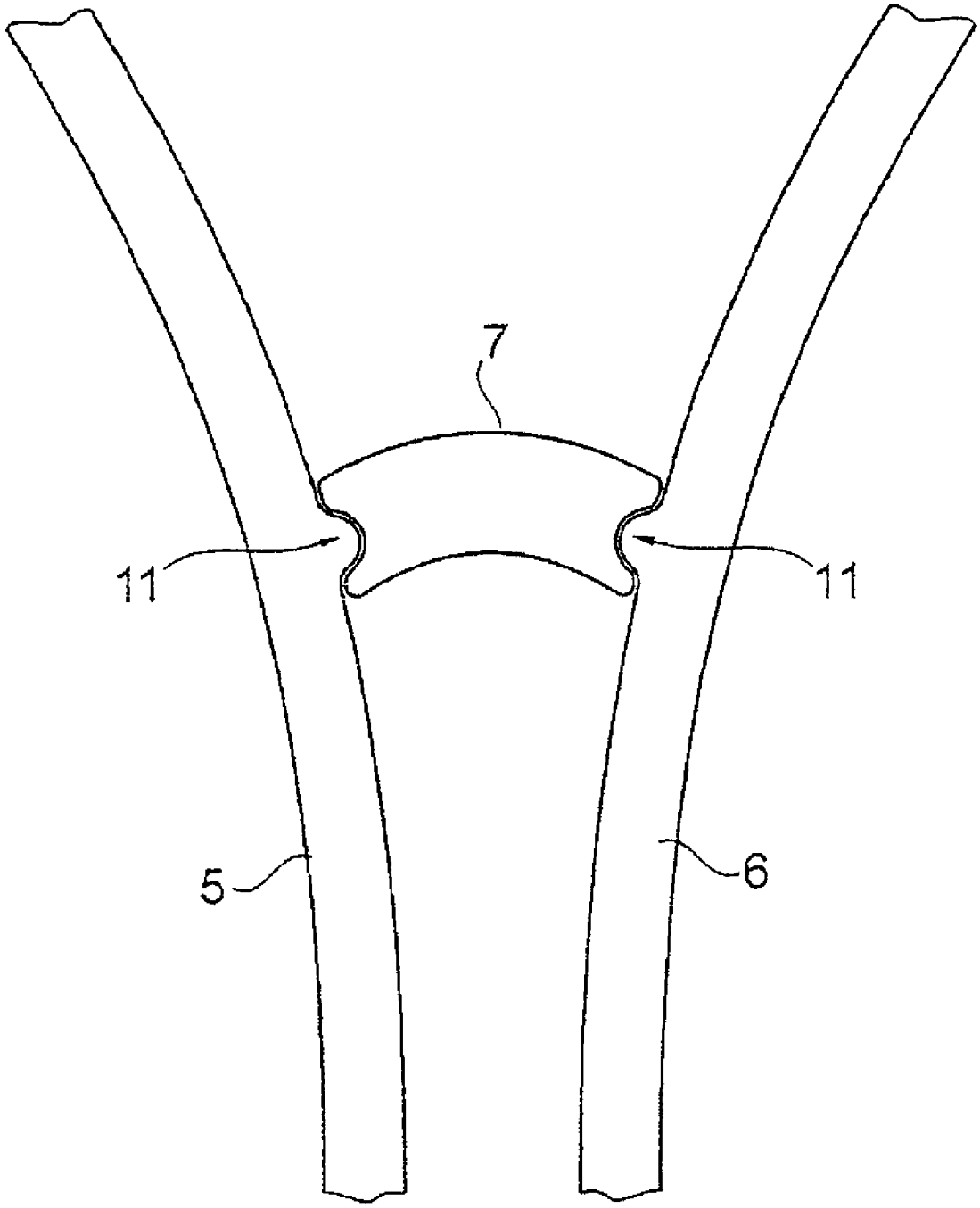
FIG. 9 is a section through the heart region of a ball game racket according to a further preferred embodiment of the present disclosure.

An alternative of this embodiment is shown in FIG. 9. Therein, the arms 5 and 6 have bulges 11 which fit into corresponding recesses of the bridge 7.

The skilled person will know that with all embodiments and alternatives thereof the problem has to be solved that the bridge has to fit into the already finalized remaining frame.

This can be guaranteed by a corresponding dimensioning, enough free spaces that will later be filled with an elastomeric material or similar aspects. If the remaining frame is flexible enough, for example in the case of a frame made of aluminum, this can easily be spread in order to insert the bridge.

Figure 10:
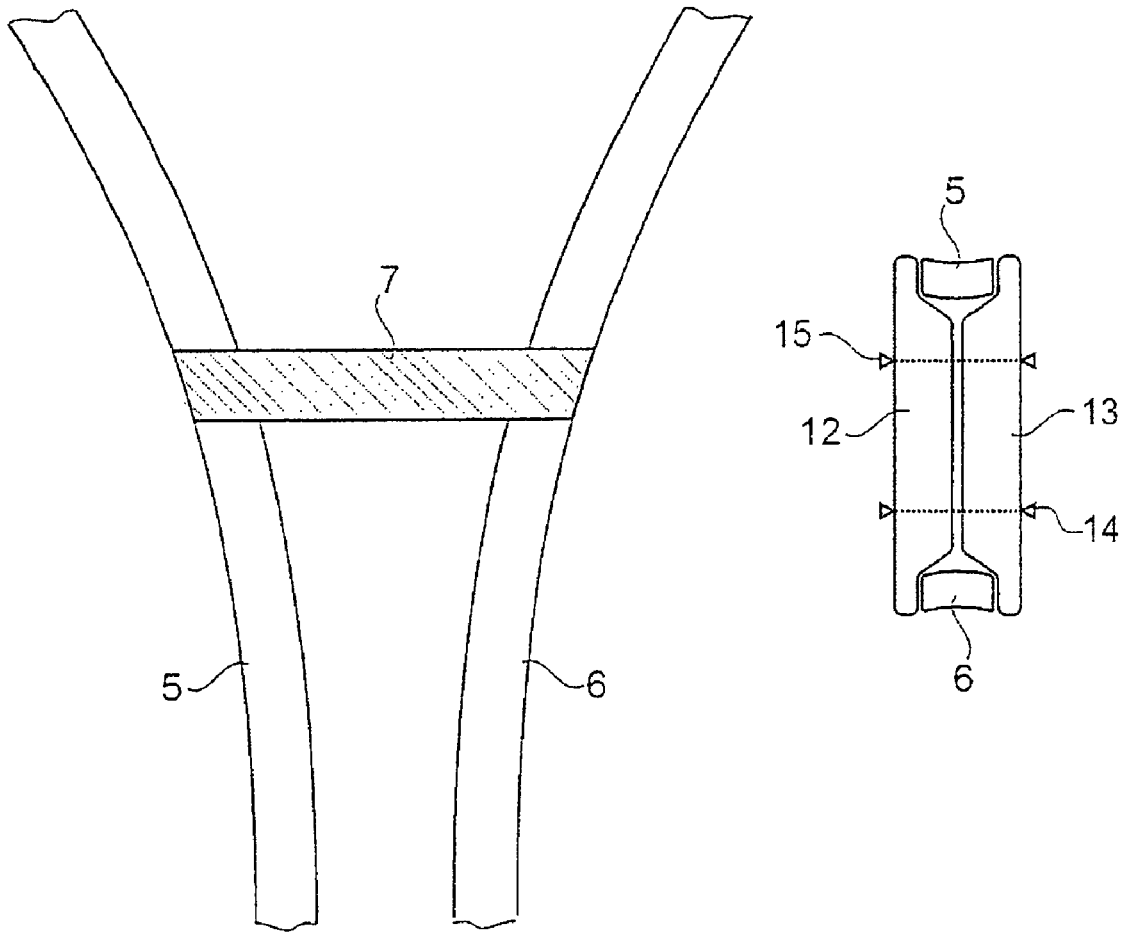
FIG. 10 is a top view of and a cross-section through the heart region of a ball game racket according to a further preferred embodiment of the present disclosure.

A different solution to the problem is outlined in FIG. 10. Here, the bridge 7 comprises, i.a, two parts 12 and 13 that form two forks at the ends of the bridge which surround the arms 5 and 6. These two parts can be positioned at the arms on both sides of the racket and fixed via two (or more) fixing mechanisms, for example gluing, clamping, screwing, staking or the like, 14 and 15. Also here, a dampening material can additionally be inserted between the parts 12 and 13 and the arms. Furthermore, the parts 12 and 13 have through holes not shown for fixing the strings.

Figure 11:
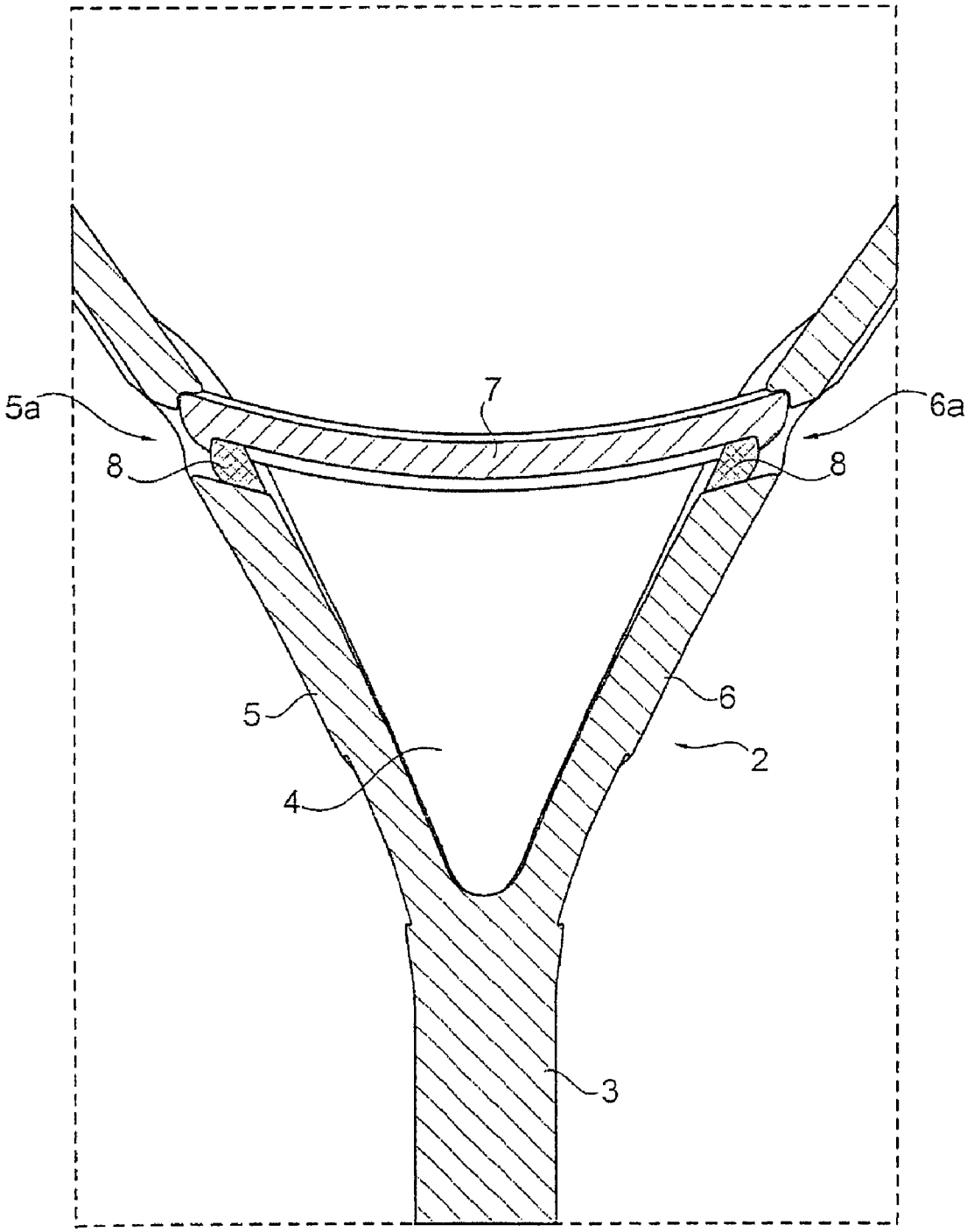
FIG. 11 is a perspective longitudinal section of the heart region of a ball game racket according to a further preferred embodiment of the disclosure.

FIG. 11 shows a perspective longitudinal section of the heart region of a ball game racket according to a further preferred embodiment according to the present disclosure. Both arms 5 and 6 of the racket according to the present disclosure have openings 5*a* and 6*a*. In both openings 5*a* and 6*a* a bridge 7 can be inserted. In accordance with FIG. 11, this happens in a particularly preferred manner via two fitting pieces 8 which fix the bridge 7 in the recesses 5*a* and 6*a* of the arms. Preferably, the fitting pieces 8 are made of an elastomeric material which can be correspondingly inserted or pressed into the recesses 5*a* and 6*a*.

Figure 12:
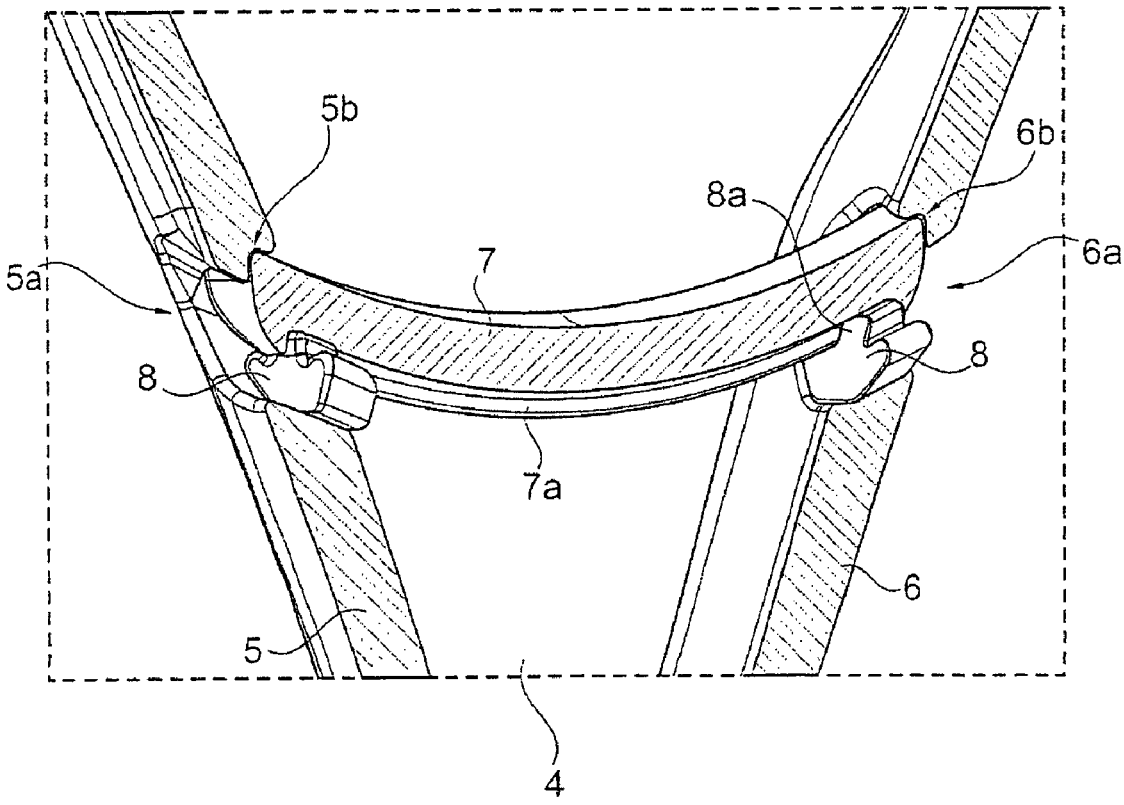
FIG. 12 is a perspective sectional view of the bridge of the racket of FIG. 11.

In the perspective sectional view of FIG. 12 it is exemplarily shown how this fixing can be carried out. Preferably, the arms 5 and 6 have recesses or grooves 5*b* and 6*b* at the edges of the opening 5*a* and 6*a* directed to the stringing plane. In these recesses or grooves, both ends of the bridge 7, which are correspondingly shaped reciprocally, can be inserted in an accurately fitting or form fit way. In order to guarantee sufficient hold or solid fixing, the fitting pieces 8 are inserted into the remaining free spaces or slits. The racket frame and the bridge 7 are shown in FIG. 12 only half whereas the fitting pieces 8 are completely visible. In other words, FIG. 12 (as well as FIG. 14) shows a racket which has been halved longitudinally and in whose one half both fitting pieces 8 were inserted subsequently. In FIG. 15 an analogous non-sectional view is shown.

Preferably, the fixing can be improved by the bridge 7 having a groove 7*a* which can engage with the corresponding portions 8*a* of the fitting pieces 8. The skilled person will know that this can also be achieved in a different way, for example by the fitting pieces 8 each having a groove that engages with a flute in the bridge.

Figure 13:
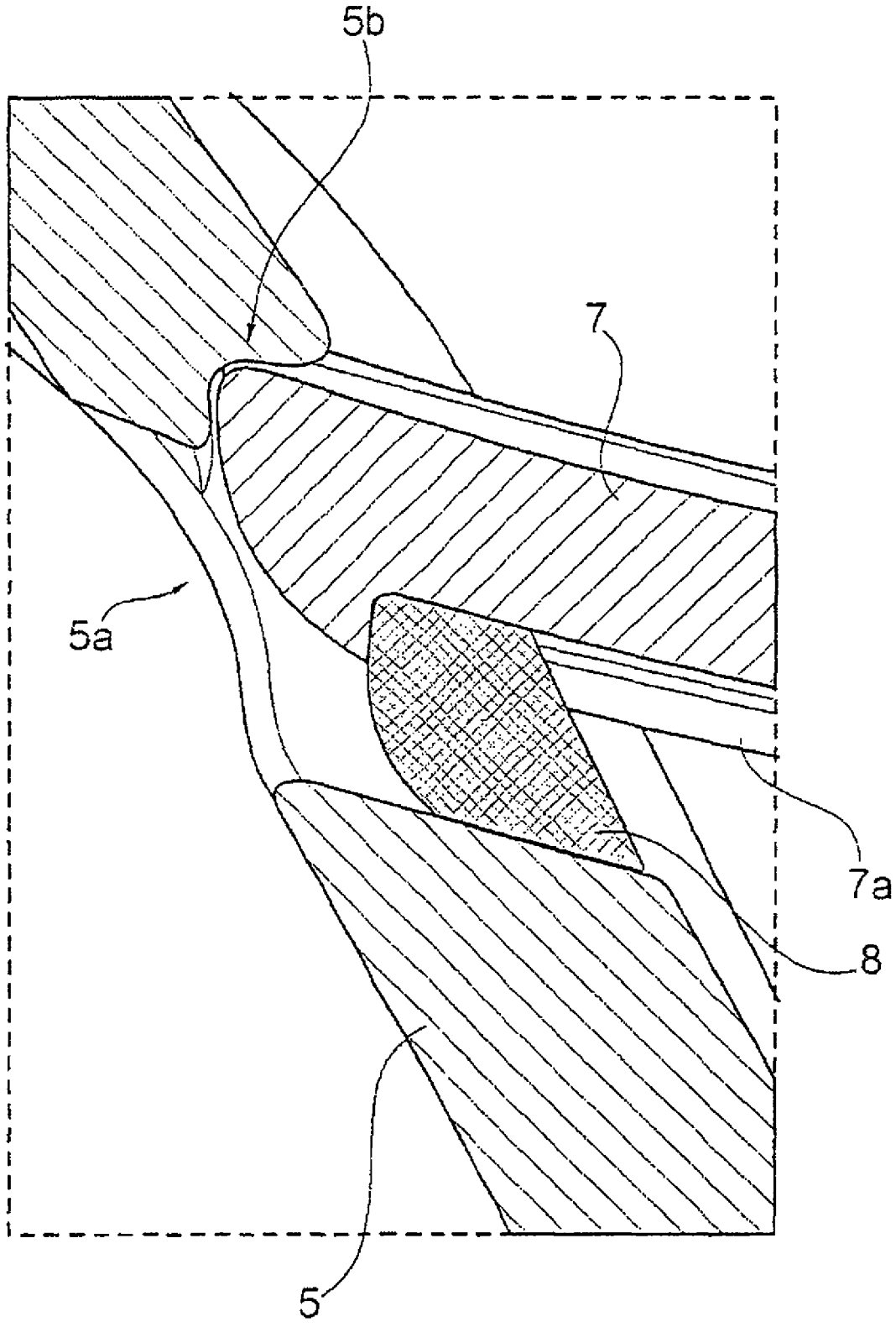
FIG. 13 is a perspective sectional view of a detail of the bridge of FIG. 12.
Figure 14:
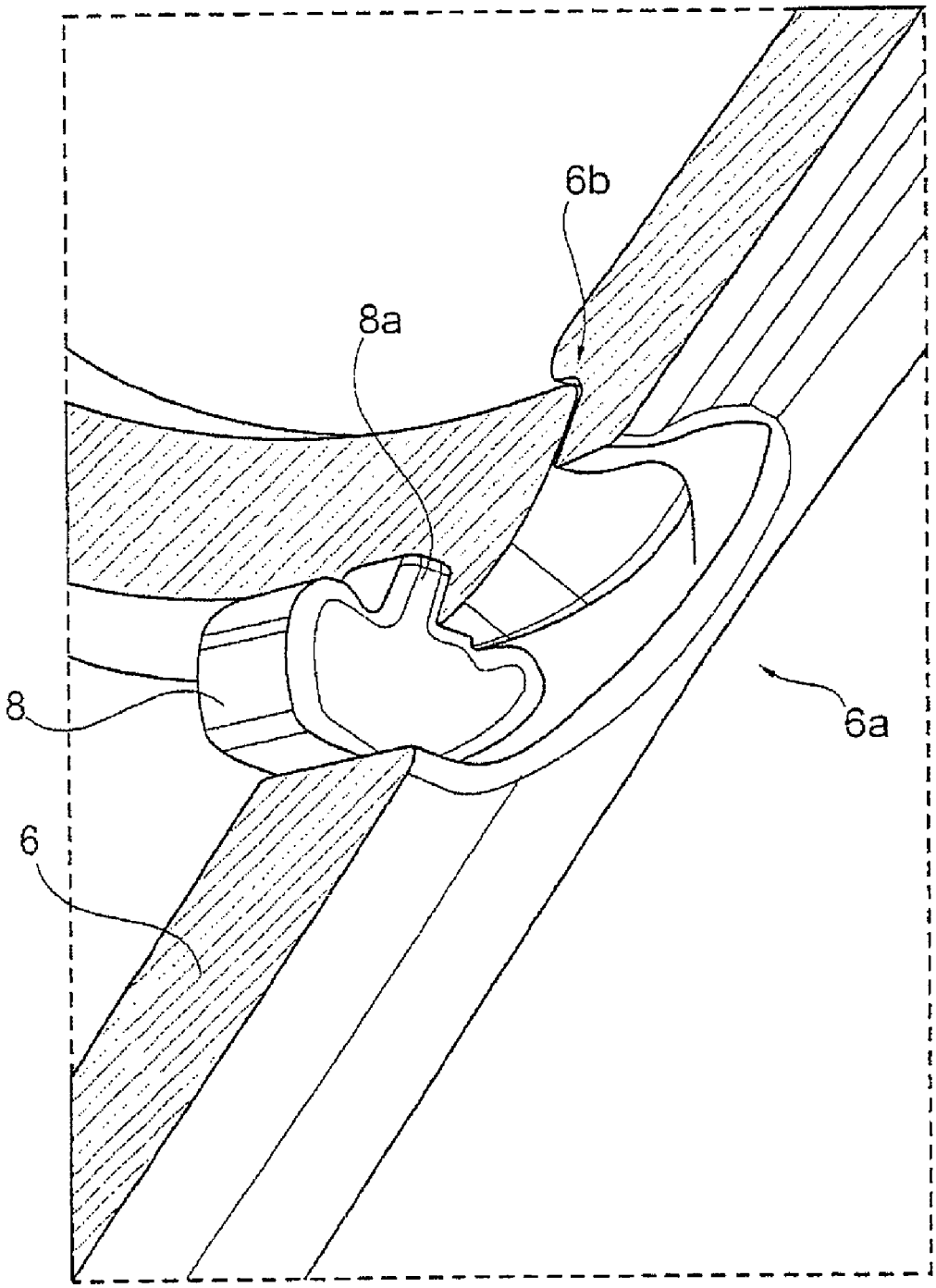
FIG. 14 is a perspective sectional view of a detail of the bridge of FIG. 12.
Figure 15:
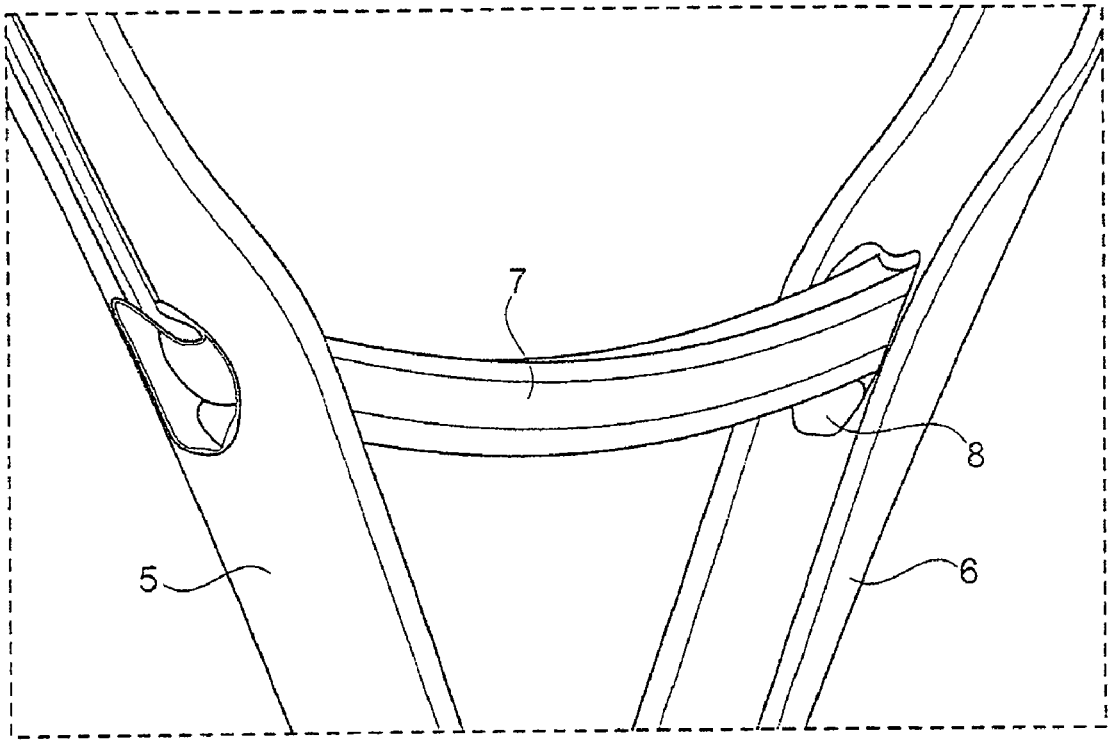
FIG. 15 is a perspective view of the bridge of the racket of FIG. 11.
Figure 16:
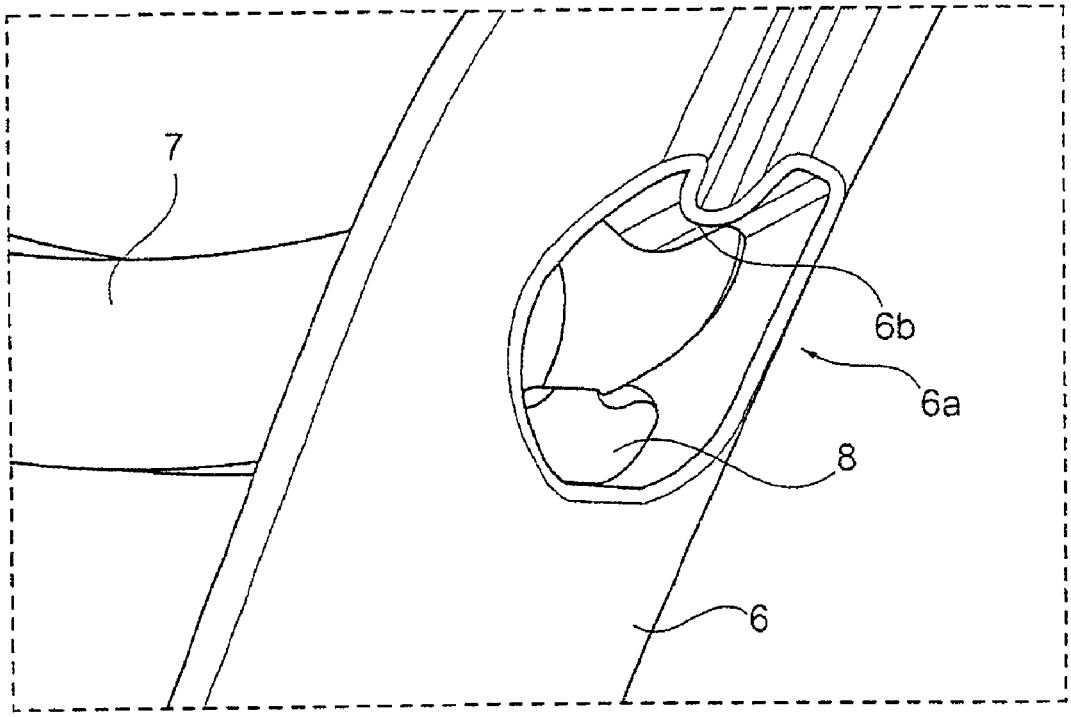
FIG. 16 is a perspective view of a detail of the bridge of the racket of FIG. 11.

FIGS. 13, 14 and 16 show detailed views of the exemplarily described fixing of the bridge according to the disclosure.

It becomes clear from FIGS. 11 to 14 that in a preferred embodiment of the disclosure, the openings 5*a* and 6*a* are dimensioned in such a way that the bridge 7 can easily be inserted into them. Preferably there is enough free space in particular in a longitudinal direction of the racket or the arms. The bridge 7 is then inserted into the openings so that it form-fits the head side edges of the openings, i.e., when the bridge is positioned in its intended position, free space remains between the bridge and the handle side edges of the openings. This free space is then particularly appropriate for retaining the mentioned fitting pieces.

The present disclosure is advantageous for the playability behavior of a racket according to the present disclosure, in that the deformation behavior can be adjusted specifically and in a controlled manner. Thus, on the one hand, the dampening material between bridge and arms allows a dampening of the impulse transferred from the strings onto the bridge, whereby the burden on the arm of the player is reduced. On the other hand, the elastic deformation of the bridge or the pivoted movement of the bridge can be used to increase the striking impulse or the striking power. Furthermore, for example the embodiment of FIG. 2 allows a controlled influence onto the spectrum of vibrations. As already explained in connection with FIGS. 3 and 4, the reaction of the longitudinal strings on the impulse of an incoming ball can be adjusted independently from that of the transverse strings. Thus, for example an enhancement of the impulse is possible via an additional tension of the transverse strings due to the bridge's deformation (see FIG. 3).

The invention claimed is:

1. A racket for ball games, comprising:

a head region for receiving a stringing defining a stringing plane;

a handle portion for holding the racket; and a heart region, wherein the heart region has two arms and a bridge, wherein each of the arms has a through hole, in which end portions of the bridge are located, and wherein the bridge is pivot-mounted at the arms regarding an axis that is basically perpendicular to the stringing plane.

2. The racket according to claim 1, wherein the bridge is connected with both arms by a dampening portion or fitting piece.

3. The racket according to claim 1, wherein the bridge is substantially V-shaped or U-shaped, wherein the V or U opens towards the head region.

4. The racket according to claim 1, wherein the bridge is V-shaped or U-shaped, wherein the V or U opens towards the handle portion.

5. The racket according to claim 1, wherein the bridge is hollow and open to both sides so that a complete passage through both arms and the bridge is provided.

6. The racket according to claim 5, wherein the passage of the bridge is configured to produce a sound when air streams past the end portions of the bridge.

7. The racket according to claim 1 wherein the through holes have head-sided and handle-sided edges and the end portions of the bridge form fit the head-sided edges.

8. The racket according to claim 7, wherein free space for receiving a fitting piece remains between the end portions and the handle-sided edges.

9. The racket according to claim 1 wherein the pivot-mounted bridge forms two axes of rotation on both arms which have a distance of at least 8 cm.

10. The racket according to claim 1 wherein the bridge has at least two turning points along a length of the bridge.

11. The racket according to claim 1, wherein the bridge receives at least 10 strings of the stringing.

12. A racket for ball games, comprising:

a head region for receiving a stringing defining a stringing plane;

a handle portion for holding the racket;

a heart region, wherein the heart region has two arms and a bridge, and the bridge is pivot-mounted about an axis that is substantially perpendicular to the stringing plane; and wherein the bridge has a fork at each end, which is suitable to mount the bridge on both arms.

13. A racket for ball games, comprising:

a head region for receiving a stringing defining a stringing plane;

a handle portion for holding the racket;

a heart region, wherein the heart region has two arms and a bridge, the arms having respective openings in which end portions of the bridge are inserted, and the bridge is pivot-mounted about an axis that is substantially perpendicular to the stringing plane; and wherein the bridge is hollow and open to both sides so that a complete passage through both arms and the bridge is provided.

* * * * *